US005398050A

United States Patent [19]

Sato

[11] Patent Number: 5,398,050

[45] Date of Patent: Mar. 14, 1995

[54] COLOR THERMAL PRINTING METHOD AND DEVICE CAPABLE OF PREVENTING UNDERLYING THERMOSENSITIVE COLORING LAYERS FROM DEVELOPING COLOR

[75] Inventor: Masamichi Sato, Tokyo, Japan

[73] Assignee: Fuji Photo Film Co., Ltd., Kanagawa, Japan

[21] Appl. No.: 967,061

[22] Filed: Oct. 28, 1992

[30] Foreign Application Priority Data

Oct. 29, 1991 [JP] Japan ..... 3-283148

[51] Int. Cl.[6] ..... B41J 2/32; B41J 2/35; B41J 2/355; B41M 5/28

[52] U.S. Cl. ..... 347/172; 346/76 R

[58] Field of Search ..... 346/76 PH, 76 R, 108

[56] References Cited

U.S. PATENT DOCUMENTS 4,833,488 5/1989 Mizutani et al. ..... 346/76 PH 5,216,438 6/1993 Nakao et al. ..... 346/76 PH

FOREIGN PATENT DOCUMENTS 61-213169 9/1985 Japan .

*Primary Examiner*—Benjamin R. Fuller

*Assistant Examiner*—Huan Tran

[57] ABSTRACT

A thermosensitive color recording material is provided having cyan, magenta, and yellow thermosensitive coloring layers formed on a supporting material in this order. As a thermosensitive coloring layer is positioned deeper within the recording material, which corresponds to a lower heat sensitivity thereof, a larger heat energy for coloring is required. The high density area of the yellow thermosensitive color layer overlaps with the low density area of the magenta thermosensitive coloring layer, and the high density area of the magenta thermosensitive color layer overlaps with the low density area of the cyan thermosensitive coloring layer. In coloring the yellow thermosensitive coloring layer, it is necessary to prevent the underlying magenta thermosensitive coloring layer from developing color. To this end, a pulse train including one bias pulse and a plurality of image pulses is divided into a plurality of subsidiary pulse trains, in order to generate a heat energy lower than the coloring heat energy necessary for obtaining a desired density. The subsidiary pulse trains are supplied to the thermal head at a slight time delay interval or in a manner which allows a sequential frame recording. Likewise, the thermal recording of the magenta thermosensitive coloring layer is performed for a plurality of times.

20 Claims, 7 Drawing Sheets

COLOR THERMAL PRINTING METHOD AND DEVICE CAPABLE OF PREVENTING UNDERLYING THERMOSENSITIVE COLORING LAYERS FROM DEVELOPING COLOR

BACKGROUND OF THE INVENTION

1. Field of the Invention

The present invention relates to a color thermal printing method and device, and more particularly to an improved color thermal printing method and device for preventing neighboring thermosensitive coloring layers from being colored at the same time.

2. Description of the Related Art

A thermosensitive color recording material has been known (e.g., Japanese Patent Laid-open No. 61-213169) which can directly print a full-color image using a thermal head without using a color ink ribbon. Documents disclosing another type of a thermosensitive color recording material 7 shown in FIG. 1 have been submitted to the Patent Office of Japan (Japanese Patent Application No. 2-89384), although they are not still laid open in public. This thermosensitive color recording material 7 has cyan, magenta, and yellow thermosensitive coloring layers 3, 4, and 5, and a protective layer 6 laminated on a supporting material 2 in this order. In this type of thermosensitive color recording material 7, the heat sensitivity of the outermost yellow thermosensitive coloring layer 5 is highest, and that of the lowermost cyan thermosensitive coloring layer 3 is lowest, as shown in FIG. 2.

The cyan thermosensitive coloring layer 3 contains as its main components an electron-donor type dye precursor and an electron-acceptor type compound, and forms a cyan dye when heated. The magenta thermosensitive coloring layer 4 contains, for example, a diazonium salt compound having a maximum absorption wavelength of 360±20 nm and a coupler which forms a magenta dye when it is thermally reacted with the diazonium salt compound. When an ultraviolet ray of 365 nm for example is applied to the magenta thermosensitive coloring layer 4 after thermal printing, the diazonium salt compound is disposed and the coloring ability the magenta thermosensitive coloring layer 4 is lost. The yellow thermosensitive coloring layer 5 contains, for example, a diazonium salt compound having a maximum absorption wavelength of 420±20 nm and a coupler which forms a yellow dye when it is thermally reacted with the diazonium salt compound. When a near ultraviolet ray of 420 nm for example is applied to the yellow thermosensitive coloring layer 4, it is optically fixed and the coloring ability of the yellow thermosensitive coloring layer 4 is lost.

When recording a full-color image on the above-described thermosensitive color recording material 7, a thermal head having a plurality of heating elements arranged in a line is used. First, the yellow thermosensitive coloring layer 5, or the first layer that is disposed on the outermost of the coloring layers, is thermally recorded, while the thermal head is moved relative to the thermosensitive color recording material 7. During the thermal recording, each heating element of the thermal head is applied with a bias pulse having a relatively large width for heating the thermosensitive color recording material 7 up to near the coloring temperature. Then a number of image pulses having a smaller width for changing the power-on time depending upon the pixel optical density of an original image and forming color pixels having a desired optical density is applied. This method of driving heating elements is described, for example, in Japanese Patent Laid-open Publication No. 3-221468. After thermally recording a yellow image, a near ultraviolet ray of 420 nm is applied to optically fix the yellow image. Next, the magenta thermosensitive coloring layer 4, or the second layer, is thermally recorded by using a higher heat energy than that applied for the yellow thermosensitive coloring layer 5. Thereafter, the magenta image is optically fixed by being exposed to an ultraviolet ray of 365 nm. Lastly, the cyan thermosensitive coloring layer 3, or the third layer, is thermally recorded by using a heat energy higher than the heat energy used for the thermosensitive color layers 4 and 5.

The thermosensitive color recording material 7 has intermediate layers formed between the thermosensitive coloring layers, although an illustration of the intermediate layers is omitted in FIG. 1. If the intermediate layers are made too thick, the heat sensitivity lowers to degree which poses a problem in practical use. However, by setting a proper thickness of the intermediate layers, the overlap between coloring characteristic curves can be avoided. Such a thermosensitive color recording material having no overlap of the characteristic curves has been proposed, for example, in Japanese Patent Application No. 2-134303. This thermosensitive color recording material is thermally recorded in the following manner. First, the yellow thermosensitive coloring layer (third thermosensitive coloring layer) is heated by a thermal head so that the heat only allows the yellow thermosensitive coloring layer to develop color. As a result, the diazonium salt compound contained in the layer reacts with the coupler and a yellow dye is formed. After the third thermosensitive coloring layer is thermally recorded and optically fixed, the magenta thermosensitive coloring layer (second thermosensitive coloring layer) is heated by the thermal head, so that the heat only allows the magenta thermosensitive coloring layer to develop color and the cyan thermosensitive coloring layer (first thermosensitive coloring layer) is not allowed to develop color. After the second thermosensitive coloring layer is optically fixed, the first thermosensitive coloring layer is heated to develop cyan color. The half tone image for yellow, magenta, and cyan can be independently recorded without color mixture by driving the thermal head under the following conditions: Thermal head: 0.5 W/dot printing energy (manufactured by Kyocera Electronics);

Pixel density: 8 pixels/mm;

Thermal head driving pulse: having a constant voltage and a power-on time changing by 0.2 ms pitch depending on the tone level.

Yellow: 0.4 to 2.0 ms;

Magenta: 2.4 to 4.0 ms;

Cyan: 4.4 to 6.0 ms.

As seen from the characteristic curves of FIG. 2, if the heat sensitivity of each thermosensitive coloring layer of the thermosensitive color recording material is raised to reduce the recording heat energy at the area EA, the high density area of the yellow thermosensitive coloring layer 5 overlaps with the low density area of the magenta thermosensitive coloring layer 4. Therefore, when a high density image for yellow is recorded, the magenta thermosensitive coloring layer 4 develops color by the heat energy applied for coloring the yellow image to cause color mixture, so that the original color hue is unable to be produced. Furthermore, at the area EB, the high density area of the magenta thermosensitive coloring layer 4 overlaps with the low density area of the cyan thermosensitive coloring layer 3, which poses the same problem as discussed above. In view of this, for the thermal recording of the yellow thermosensitive coloring layer 5 and the magenta thermosensitive coloring layer 4, the heat energy which does not allow the layer under each thermosensitive coloring layer to develop color, has been used conventionally. For this reason, with a conventional thermal color printing method, a high density image cannot be recorded in some cases.

SUMMARY OF THE INVENTION

It is an object of the present invention to provide a color thermal printing method and device capable of preventing an underlying thermosensitive coloring layer from developing color by a surplus heat energy applied for developing color of a high density image on the overlying thermosensitive coloring layer.

The present inventor has made various experiments in an effort to prevent color mixture, and has found that application of a low heat energy which does not allow color mixture for a plurality of times, can develop color of a high density image without color mixture. The embodiments of the present invention are based upon this finding. In summary, in the thermal recording of a thermosensitive coloring layer overlapping with the underlying thermosensitive coloring layer at a certain heat energy level, the thermal recording is performed for a plurality of times at a heat energy lower than the underlying layer coloring heat energy.

In performing the thermal recording for a plurality of times, the thermal head may be driven consecutively with a small time delay between each drive, or a thermosensitive color recording material may be placed under the thermal head two times or more.

According to the present invention, in the thermal recording of a thermosensitive coloring layer overlapping with the underlying thermosensitive coloring layer at a certain heat energy level, the thermal recording is performed for a plurality of times at a heat energy lower than the underlying layer coloring heat energy. Accordingly, color mixture at the underlying layer when developing color of the overlying thermosensitive coloring layer can be prevented even if the coloring density is raised, and thereby a color reproduction is improved.

BRIEF DESCRIPTION OF THE DRAWINGS

The above and other objects and advantages of the invention will become apparent from the following detailed description of the preferred embodiments when read in conjunction with the accompanying drawings, wherein.

DETAILED DESCRIPTION OF THE PREFERRED EMBODIMENTS

Figure 1:
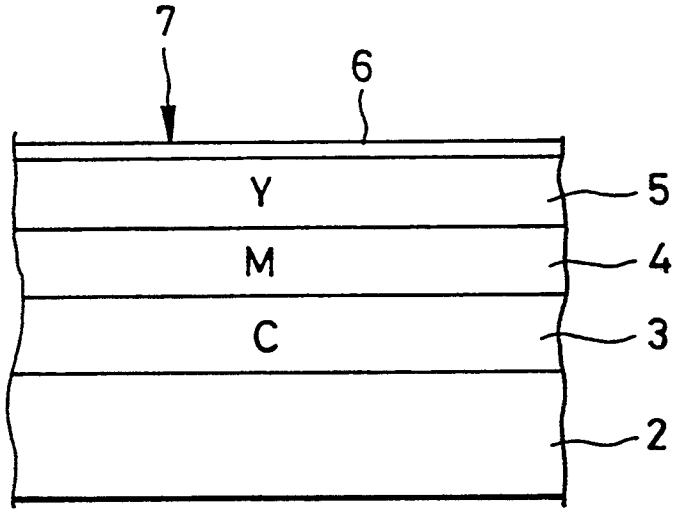
FIG. 1 is an explanatory view of the layer structure of a color thermosensitive recording material used to practice the color thermal printing method according to an embodiment of the present invention.
Figure 2:
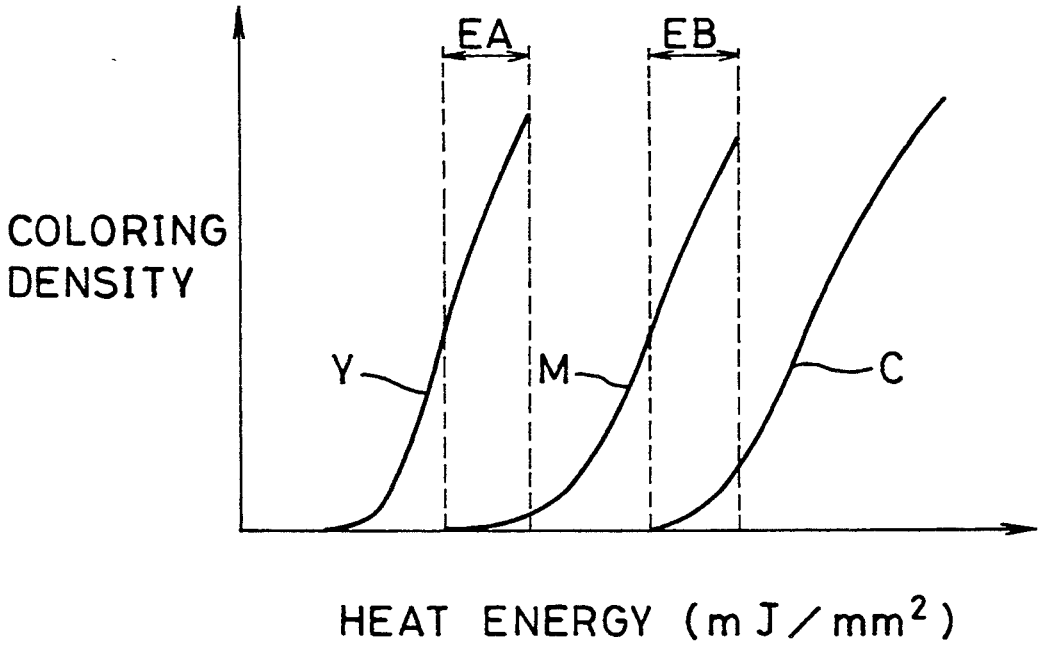
FIG. 2 is a graph showing coloring characteristics of each thermosensitive coloring layer shown in FIG. 1.
Figure 3:
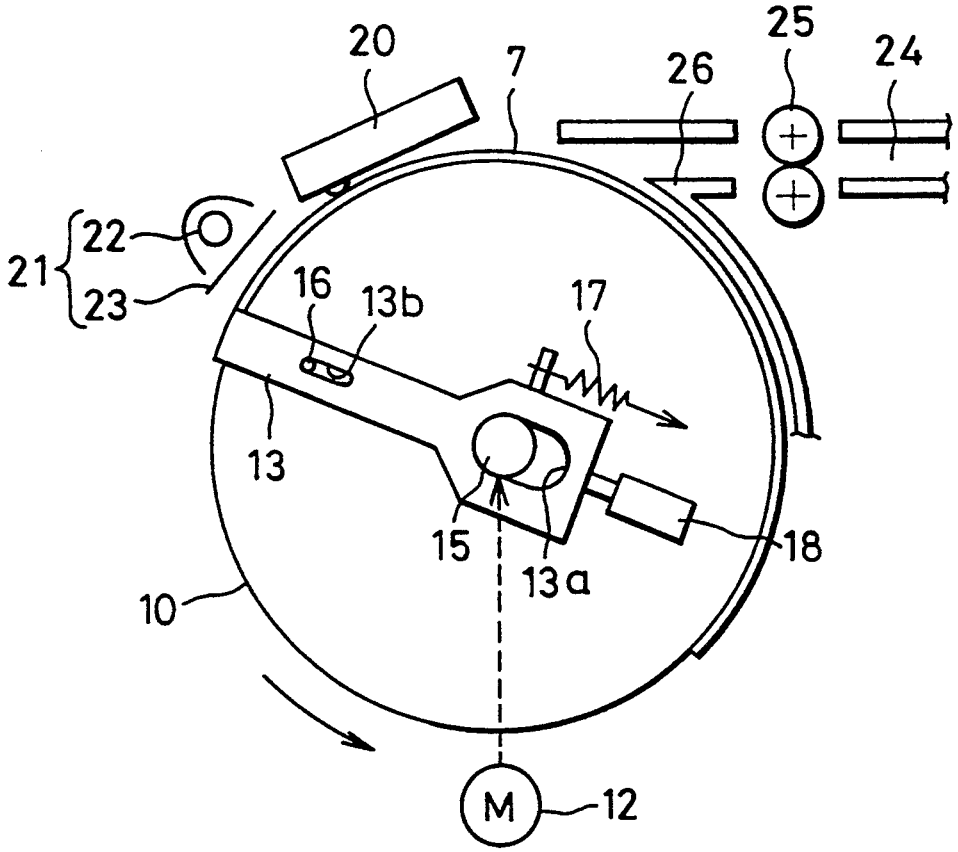
FIG. 3 is a schematic diagram of a color thermal printer used to practice the color thermal printing method according to an embodiment of the present invention.

In FIG. 3, a platen drum 10 carries a thermosensitive color recording paper 7 on the outer periphery thereof, and is rotated by a pulse motor 12 in a direction of the arrow during thermal recording. The platen drum 10 is provided with a clamp member 13 which secures the thermosensitive color recording paper 7 to the platen drum 10 at least at a portion, for example, of the leading end of the thermosensitive color recording paper 7. The clamp member 13 is of a channel shape having a clamp portion extending in an axial direction of the platen drum 10 and arm portions extending in a radial direction of the platen drum 10. Slots 13*a* and 13*b* are formed in either arm portion. The slots 13*a* are engaged with both ends of a platen drum shaft 15, and the slots 13*b* are engaged with guide pins 16 provided on both sides of the platen drum 10. The clamp portion of the clamp member 13 is ordinarily pressed onto the platen drum 10 by a spring 17, and is removed off the platen drum 10 by an act of a solenoid 18 when the thermosensitive color recording paper 7 is to be placed on or displaced from the platen drum 10.

Figure 4:
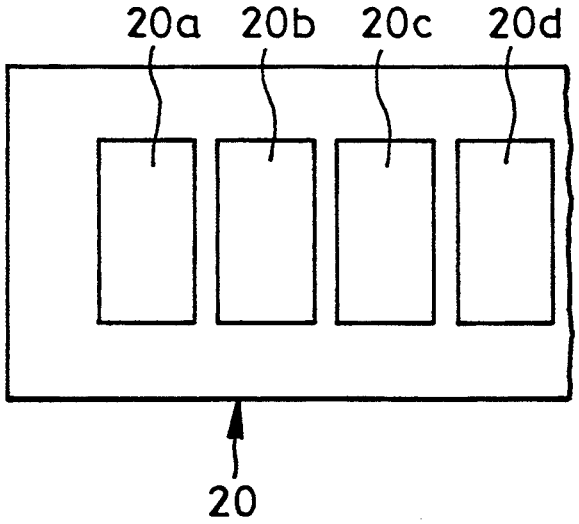
FIG. 4 is an explanatory view of a thermal head.
Figure 5:
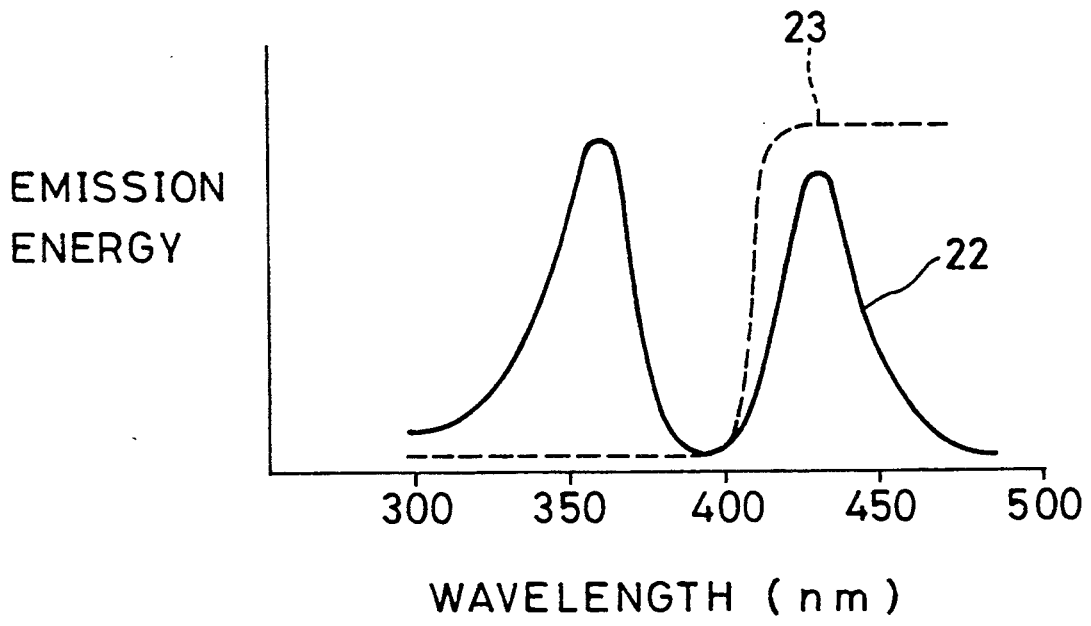
FIG. 5 is a graph showing the characteristics of an ultraviolet lamp and a sharp-cut filter of an optical fixing device.

Above the outer periphery of the platen drum 10, a thermal head 20 having a plurality of heating elements 20*a*, 20*b*, 20*c*, . . . as shown in FIG. 4 and arranged in a line, and an optical fixing device 21 are disposed. The optical fixing device 21 includes a stick-shaped ultraviolet lamp 22 having two emission centers at wavelengths of near 365 nm and 420 nm, as shown by solid lines in FIG. 5, and a sharp-cut filter 23 having a transmission curve as shown by a dashed line in FIG. 5. The sharp-cut filter 23 is placed on the front of the ultraviolet lamp 22 by means of a solenoid or another device, so as to transmit near ultraviolet rays having a wavelength range of about 420 nm. A paper feed path 24 is provided with a pair of feed rollers 25 through which the thermosensitive color recording paper 7 is fed to the platen drum 10 and, thereafter, is ejected from the platen drum 10. Downstream of the paper feed path 24, that is, on the side near to the platen drum 10, a peeling member 26 is provided for peeling off the trailing end of the thermosensitive color recording paper 7 from the platen drum 10 and guiding the thermosensitive color recording paper 7 to the paper feed path 24 in ejecting the thermosensitive color recording paper 7. In this embodiment, although the paper feed path 24 is commonly used for paper feeding and ejecting, it is possible to provide a paper ejection path separately from a paper feed path.

Figure 6:
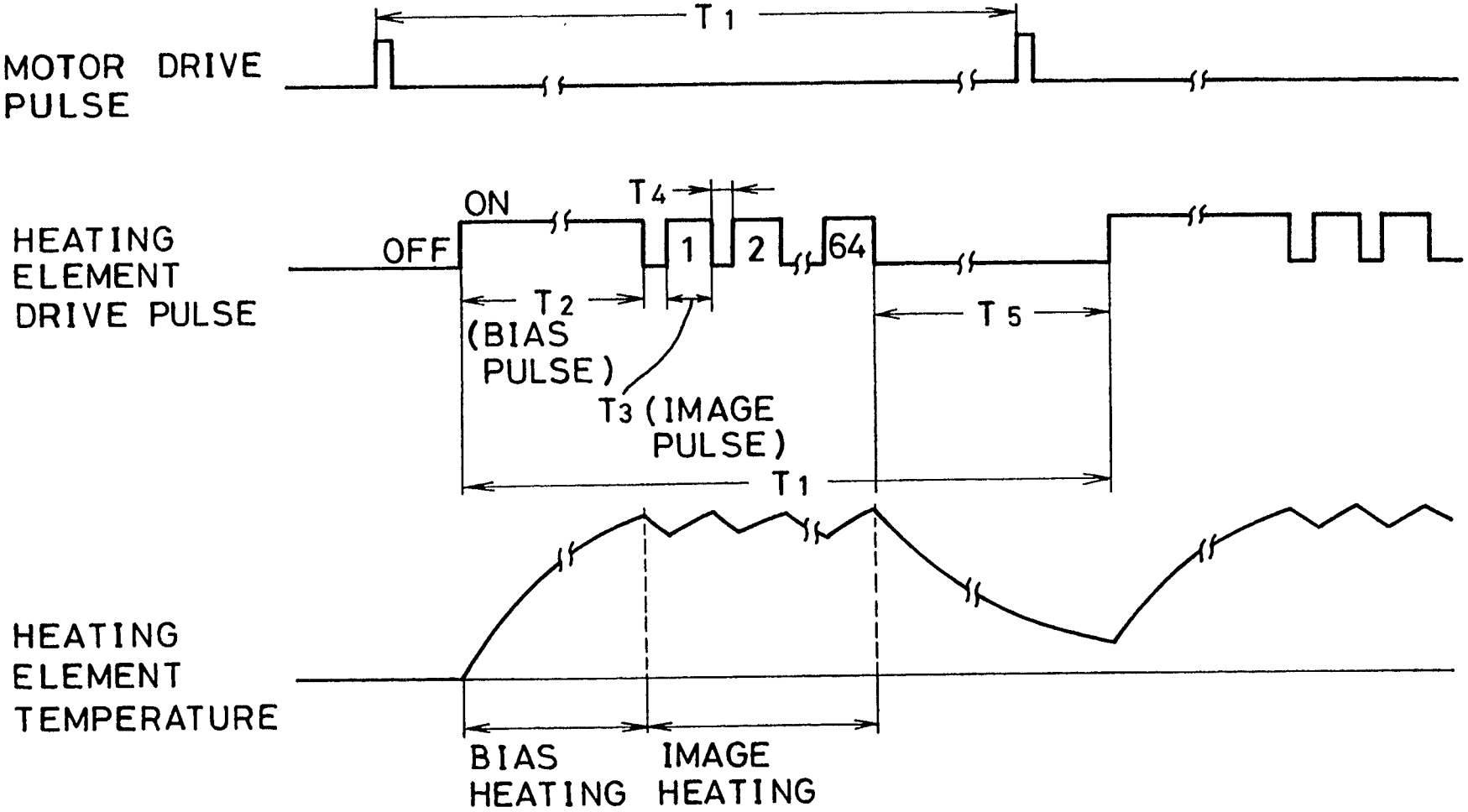
FIG. 6 shows waveforms of signals at a head drive unit and a waveform illustrating the heating state of a heating element.

One image pixel is constituted by three color pixels for yellow, magenta, and cyan. Each color pixel is formed by driving a heating element by a pulse train. The pulse train includes at least one bias pulse for generating a bias heat energy, and image pulses corresponding in number to the tone level for generating a heat energy to reproduce tone. As shown in FIG. 6, the drive data of one line are generated, while being split into 65 steps, inclusive of the bias drive pulse, assuming that the tone level of each pixel has 64 steps.

Therefore, the heating elements of the thermal head 20 are driven by the bias drive pulse and, thereafter, selectively driven by the 1 to 64 image drive pulses, while 65 strobe signals are applied. As a result, a line of pixels having 64 tone levels are recorded. T1 represents a recording cycle allocated for recording one pixel which is set shorter for the thermosensitive coloring layer having a higher heat sensitivity. T2 represents a pulse duration of the bias drive pulse for bias heating, which is set smaller for the thermosensitive coloring layer having a higher heat sensitivity. T3 represents an ON duration of one image pulse which is set smaller for the thermosensitive coloring layer having a higher heat sensitivity. These pulse durations T2 and T3 are determined by the pulse duration of the strobe signal. T4 represents an OFF duration of one image pulse which is the same for each thermosensitive coloring layer. T5 represents a cooling time period which is variable depending on the tone level and is set smaller for the thermosensitive coloring layer having a higher heat sensitivity.

Figure 7:
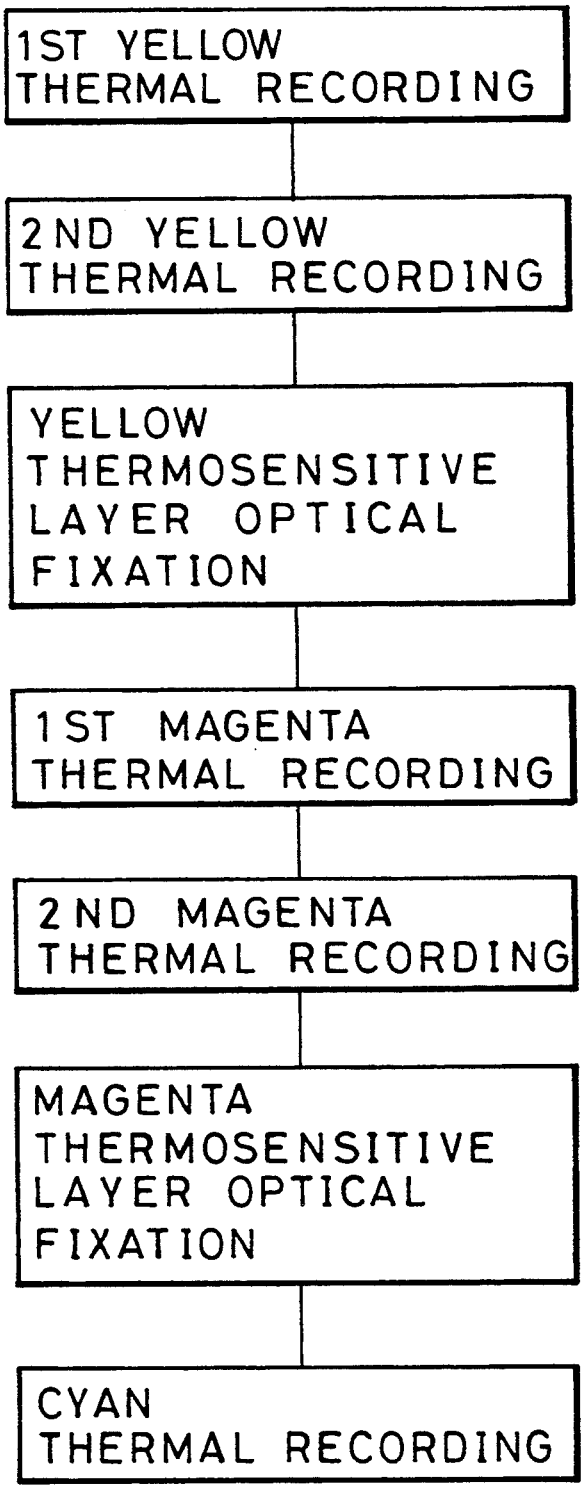
FIG. 7 is a flow chart showing the color thermal printing method according to an embodiment of the present invention.

The operation of the color thermal printer will be briefly described with reference to FIGS. 7 and 8. During paper feeding, the platen drum 10 stays in a situation where the clamp member 13 is placed at the exit of the paper feed path 24 with its arm portions oriented vertically in FIG. 3. When the solenoid 18 is energized, the clamp member 13 is set to a clamp release position where the clamp portion thereof is removed off the platen drum 10. The pair of feed rollers 25 nip and feed the thermosensitive color recording paper 7 toward the platen drum 10. The feed rollers 25 stop rotating when the leading end of the thermosensitive color recording paper 7 is placed between the platen drum 10 and the clamp member 13. Thereafter, when the solenoid is turned off, the clamp member 13 is returned to the initial position according to the act of the spring 17, for thereby clamping the leading end of the thermosensitive color recording paper 7. After clamping the thermosensitive color recording paper 7, the platen drum 10 and the feed rollers 25 start rotating, so that the thermosensitive color recording paper 7 is wound on the outer periphery of the platen drum 10.

The platen drum 10 is rotated intermittently by a predetermined step. When a leading edge of a recording area of the thermosensitive color recording paper 7 reaches the thermal head 20, the first thermal recording of the yellow thermosensitive coloring layer 5 is started.

Figure 8:
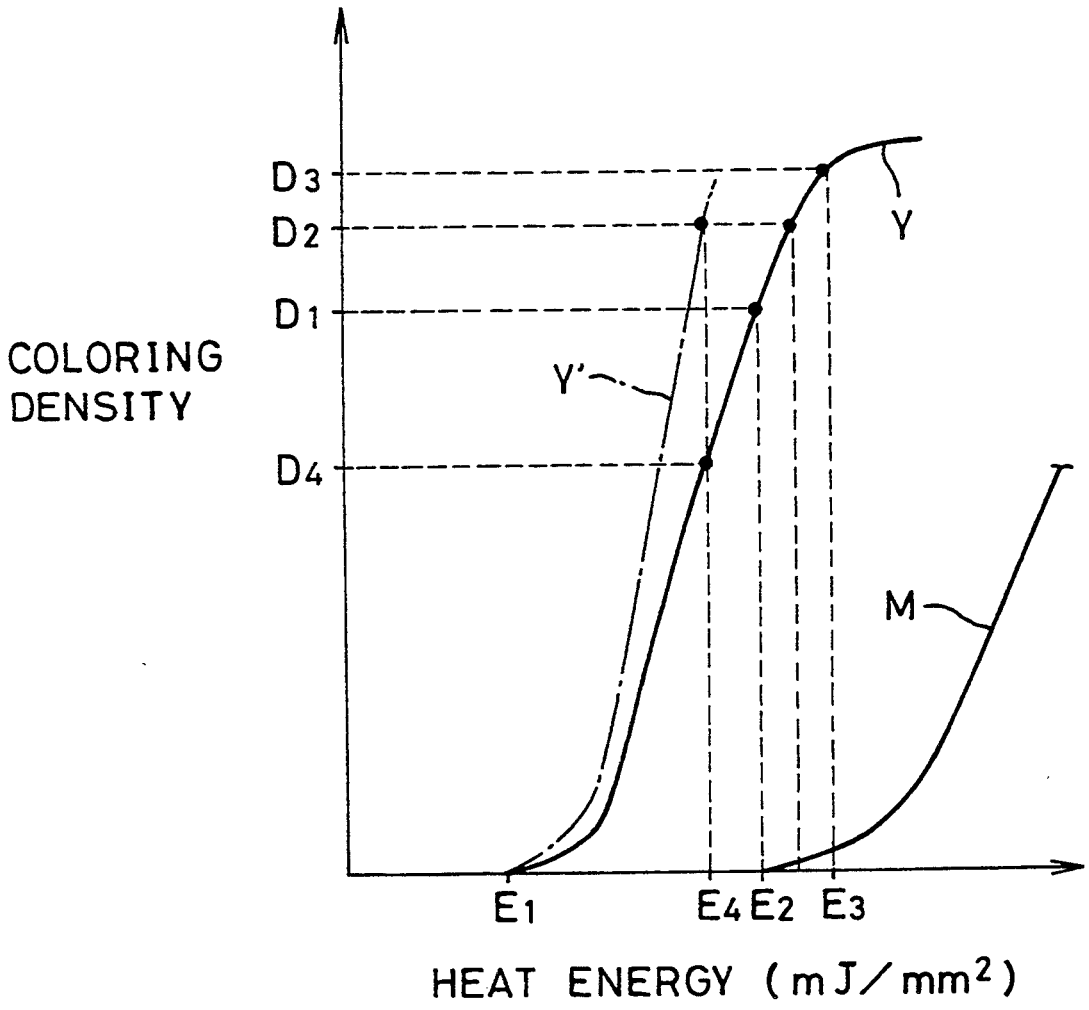
FIG. 8 is a graph showing the relationship between the number of thermal recording times and the coloring characteristics of a yellow thermosensitive coloring layer.

In the coloring density area up to $D_4$ shown in FIG. 8, the underlying magenta thermosensitive coloring layer 4 will not develop color. Therefore, during the thermal recording of the yellow thermosensitive coloring layer 5, a pulse train, which includes a bias pulse and image pulses corresponding in number to the tone level shown in FIG. 6, is applied. Each heating element is consecutively driven to apply a desired heat energy to each pixel to develop yellow color at a desirable density.

In the coloring density area from $D_1$ to $D_3$ shown in FIG. 8, if the corresponding heat energy $E_2$ to $E_3$ is applied to the thermosensitive color recording paper 7, the underlying magenta thermosensitive coloring layer 4 is colored at the time of coloring the yellow thermosensitive coloring layer 5, so that color mixture is generated. In this case, the thermal recording of the yellow thermosensitive coloring layer 5 is performed twice, by heating the thermal head 20 at the heat energy area from $E_1$ to $E_2$. For example, for the coloring density $D_2$, the heat energy $E_4$ is applied at the first thermal recording to obtain the coloring density $D_4$, and then the heat energy $E_4$ is applied at the second thermal recording to obtain the final coloring density $D_2$. Performing the thermal recording twice corresponds to a change of the characteristic curve Y shown by the solid line in FIG. 8 to the curve Y′ shown by a broken line. In this way, it becomes possible to develop color at a high density without any color mixture. The energy $E_4$ for performing the thermal recording twice is set to a value corresponding to the coloring density which is slightly higher than Dmax/2 and lower than the density $D_1$, where Dmax is the maximum coloring density of the yellow thermosensitive coloring layer 5 obtained by continuously energizing the thermal head 20 at a constant voltage level, and the density $D_1$ is the density at which magenta color mixture starts. It is to be noted that such a heat energy is experimentally obtained for each target density.

In performing the thermal recording twice, the first thermal recording develops color to a density higher than half the target coloring density, and the second thermal recording develops color to a density lower than that at the first thermal recording because couplers still remaining in the layer are less than the first thermal recording. The lower density ($D_2$–$D_4$) obtained at the second thermal recording is added to the density $D_4$ obtained at the first thermal recording. In this way, the target density $D_2$ can be obtained by performing the thermal recording twice.

The yellow thermosensitive coloring layer 5 develops color at a desirable density by driving the thermal head 20 at the thermal energy $E_4$ with the pulse train including the bias pulse and a plurality of image pulses shown in FIG. 6. When the recording of the first line of pixels is completed, the platen drum 10 is rotated by the pulse motor 12 by an amount corresponding to one pixel to thermally record the yellow image of the second line. In a similar manner, the yellow image of the third and following lines is thermally recorded on the thermosensitive color recording paper 7 to record all lines of the yellow image.

When the platen drum 10 makes one revolution to place the leading edge of the recording area of the thermosensitive color recording paper 7 again under the thermal head 20, the second thermal recording of the yellow thermosensitive coloring layer 5 starts. The second thermal recording is performed under the condition same as the first thermal recording.

During the second yellow thermal recording, the part of the recording paper 7 on which the yellow image has been recorded is moved under the optical fixing device 21, and the yellow thermosensitive coloring layer 5 is optically fixed. At that time, because the sharp-cut filter 23 is placed in front of the ultraviolet lamp 22, the thermosensitive color recording paper 7 is exposed to near ultraviolet rays having a wavelength range of about 420 nm, so that the diazonium salt compound remaining in the yellow thermosensitive coloring layer 5 is optically decomposed to lose the coloring capacity thereof.

When the platen drum 10 makes one revolution to place the leading edge of the recording area of the thermosensitive color recording paper 7 again under the thermal head 20, the thermal head 20 performs the first thermal recording of the magenta thermosensitive coloring layer 4 in a manner similar to the thermal recording of the yellow thermosensitive coloring layer 5. At this time, the yellow thermosensitive coloring layer 5 will not be colored because it has already been optically fixed.

When the platen drum 10 makes one further revolution, the second thermal recording for the magenta image starts. When the thermosensitive color recording paper 7 reaches the optical fixing device 21 during the second magenta thermal recording, the thermosensitive color recording paper 7 is optically fixed. In this case, because the sharp-cut filer 23 is removed from the front of the ultraviolet lamp 22, all electromagnetic waves radiated from the lamp 22 are applied to the thermosensitive color recording paper 7. Of the electromagnetic waves, the ultraviolet rays near 365 nm optically fix the magenta thermosensitive coloring layer 4. In this manner, performing the thermal recording of the magenta thermosensitive coloring layer 4 twice with a small heat energy allows the magenta thermosensitive coloring layer 4 to be colored without coloring the underlying cyan thermosensitive coloring layer 3, in a similar manner to the case of the yellow thermal recording.

When the platen drum 10 makes one further revolution so as to place the recording area under the thermal head 20, the thermal recording of a cyan image starts. The thermal head 20 applies the heat energy corresponding to the coloring density to the thermosensitive color recording paper 7, for recording the cyan image line by line in the cyan thermosensitive coloring layer 3. Because the color mixture will not occur in the cyan thermosensitive coloring layer 3, the thermal recording is performed once. No optical fixation will be carried out and the optical fixing device 21 is turned off.

After recording the yellow, magenta, and cyan images, the platen drum 10 and the pair of feed rollers 25 are rotated reversely. Thereby, the trailing end of the thermosensitive color recording paper 7 is guided by the peeling member 26 into the paper feed path 24, and is nipped by the feed rollers 25. Thereafter when the platen drum 10 reaches the initial position at which the clamp member 13 is placed at the exit of the paper feed path 24, the solenoid 18 is turned on, and simultaneously the platen drum 10 stops rotating. When the solenoid 10 is turned on, the clamp member 13 is moved to the release position against the action of the spring 17, so that the leading end of the thermosensitive optical recording paper 7 is released from the clamp member 13, and is ejected from the platen drum 10 through the paper feed path 24 onto a paper tray.

Figure 9:
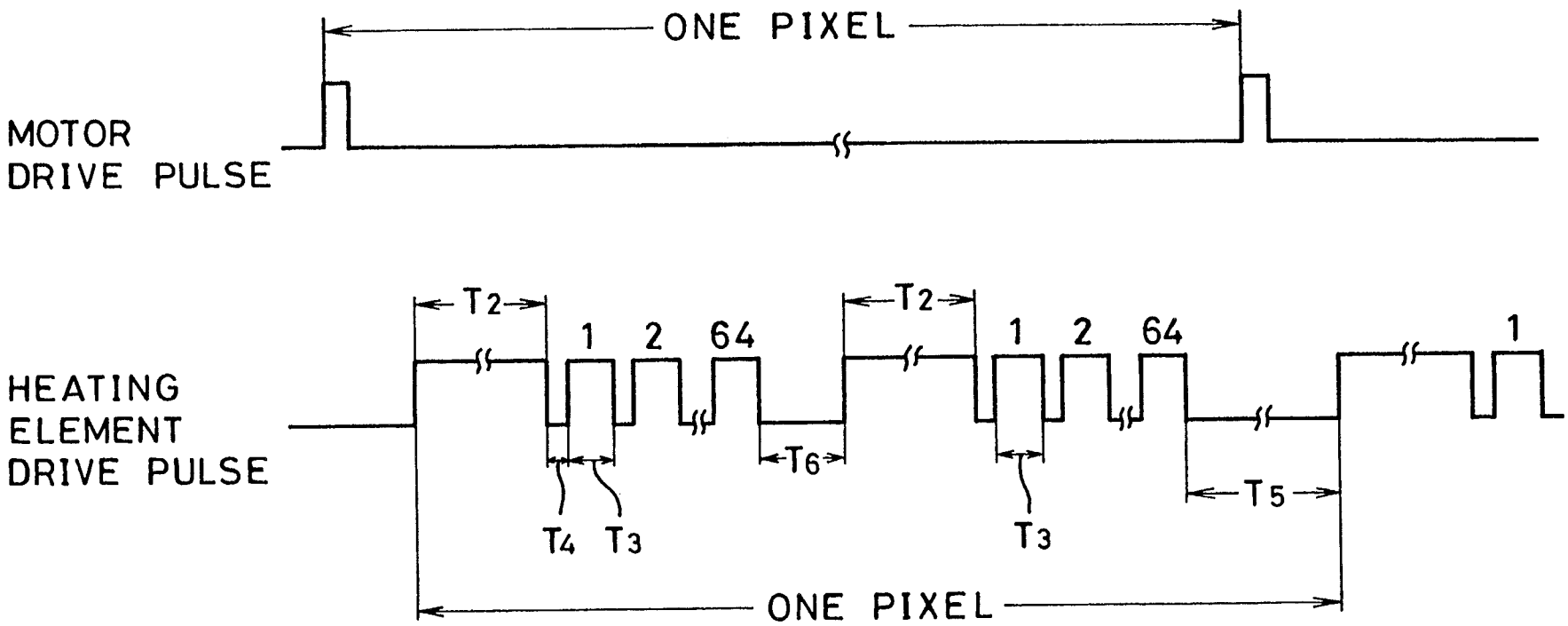
FIG. 9 is a graph showing drive pulses in an embodiment wherein the same pixel is thermally recorded two consecutive times.

The heating elements may be driven a plurality of times with a predetermined time delay therebetween. In this case, while the platen drum 10 rotates once, the thermal recording for one color is completed, and the printing time is shortened. FIG. 9 shows waveforms of drive pulses of this embodiment. While the heating element faces the same pixel, two pulse trains with a cooling period T6 (sufficiently longer than T4 ) interposed therebetween are used for driving the heating element twice.

In the above embodiments, the thermal recording for the same color is performed twice under the same condition. Instead, the heat energy may be changed between the first and second thermal recording. In this case, two types of table data are used to generate a different drive signal for the same image data for either of the first and second thermal recording. The thermal recording for the yellow and magenta thermosensitive coloring layers is performed twice. The number of thermal recording times may be three or more depending upon the coloring characteristics of a thermosensitive color recording material. For performing the thermal recording three times, the heat energy for coloring at a density slightly higher than Dmax/3 may be used as a target energy E4. The multiple thermal recording is performed for the yellow and magenta thermosensitive coloring layers in the above embodiments. However, the multiple thermal recording may be performed only for the yellow thermosensitive coloring layer which has a great effect to color mixture. In this case, the printing time is shortened by the time required for recording the magenta thermosensitive coloring layer once.

The heat energy necessary for coloring the undermost cyan thermosensitive coloring layer 3 has such a large value that cannot be applied to the recording paper under a normal keeping condition. Therefore, the cyan thermosensitive coloring layer 3 is not given a capacity of being optically fixed. However, a capacity of being optically fixed may be given to the cyan thermosensitive coloring layer 3 if necessary. Furthermore, although the above described embodiments only relate to a line printer wherein a plurality of heating elements are arranged in the subscan direction, and the thermosensitive color recording paper is moved linearly relative to the thermal head in the sub-scan direction, further embodiments of the present invention are applicable to serial printers wherein pixels are serially printed by a two-dimensional movement of the thermosensitive color recording paper relative to the thermal head. Additionally, instead of the platen drum, a paper feed path provided with a plurality of rollers may be used to reciprocally move the thermosensitive color recording paper along this paper feed path.

Although the present invention has been fully described by way of the preferred embodiments thereof with reference to the accompanying drawings, various changes and modifications will be apparent to those of working skill in this field. Therefore, unless otherwise these changes and modifications depart from the scope of the present invention, they should be construed as included therein.

I claim:

1. A color thermal printing method for forming a full-color image on a thermosensitive color recording material having at least first, second, and third thermosensitive coloring layers being different in color to be developed which are arranged in a predetermined order with the second thermosensitive coloring layer disposed on the first thermosensitive coloring layer and the third thermosensitive coloring layer disposed on the second thermosensitive coloring layer, by performing a thermal recording and optical fixation downward from the third thermosensitive coloring layer, said thermosensitive coloring recording material having characteristics so that when the third thermosensitive coloring layer is colored by applying heat energy continuously or intermittently up to a first predetermined density, the second thermosensitive coloring layer is inevitably colored by a small amount, and after the third thermosensitive coloring layer is optically fixed and when the second thermosensitive coloring layer is colored by applying heat energy continuously or intermittently up to a second predetermined density inclusive of a maximum density, the first thermosensitive coloring layer is inevitably colored by a small amount, the color thermal printing method comprising the steps of:

dividing a thermal recording of one of the first, second and third thermosensitive coloring layers into a plurality of coloring processes in order to color said one thermosensitive coloring layer selectively up to the second predetermined density inclusive of the maximum density, during one of said coloring processes said one thermosensitive coloring layer is colored while suppressing an underlying layer which underlies said one thermosensitive coloring layer from developing color, then a sufficient power off period being provided for suppressing said underlying layer from developing color when a subsequent coloring process follows; and performing said respective coloring processes for color development up to the second predetermined density.

2. A color thermal printing method for recording a full-color image on a thermosensitive color recording material having at least first, second, and third thermosensitive coloring layers formed on a supporting material which are arranged in a predetermined order with the second thermosensitive color layer disposed on the first thermosensitive coloring layer and the third thermosensitive coloring layer disposed on the second thermosensitive coloring layer, by using a thermal head, the first thermosensitive coloring layer containing as the main components an electron-donor type dye precursor and an electron-acceptor type compound, the second thermosensitive coloring layer containing a first diazonium salt compound having a maximum absorption wavelength of 360±20 nm and a first coupler which develops color when the first coupler is thermally reacted with the first diazonium salt compound, the third thermosensitive coloring layer containing a second diazonium salt compound having a maximum absorption wavelength of 420±20 nm and a second coupler which develops color when the second coupler is thermally reacted with the second diazonium salt compound, the first, second, and third thermosensitive coloring layers having the coloring characteristics that when the third thermosensitive coloring layer is selectively colored by continuously driving the thermal head with a first pulse having a first predetermined voltage and a first predetermined width, the second thermosensitive coloring layer is inevitably colored by a small amount, and after the third thermosensitive coloring layer is optically fixed and when the second thermosensitive coloring layer is selectively colored by continuously driving the thermal head with a second pulse having a second predetermined voltage and a second predetermined widths the first thermosensitive coloring layer is inevitably colored by a small amount, the thermal head having a plurality of heating elements, each of the heating elements being driven by a pulse train including a bias pulse for raising temperature of each of the heating elements near a coloring temperature and a plurality of image pulses which change in a power-on time depending upon a pixel density of an original image, and each of the heating elements heating the thermosensitive color recording material from a surface of the third thermosensitive coloring layer to selectively and thermally record one pixel on one of the first, second, and third thermosensitive coloring layers, the thermal color printing method comprising the steps of:

thermally recording either of the second and third thermosensitive coloring layers under the condition that the pulse train is divided into a plurality of subsidiary pulse trains, each of said subsidiary pulse trains recording the pixel at a density lower than a desired pixel density, and an entirety of said plurality of subsidiary pulse trains recording the pixel at a desired final pixel density;

providing a cooling period between two adjacent of said subsidiary pulse trains, said cooling period being sufficiently longer than a power off time of each period of the image pulses; and consecutively supplying said plurality of subsidiary pulse trains to the thermal head to record the pixel on each of the first, second, and third thermosensitive coloring layers while suppressing an underlying layer of each of the first and second thermosensitive coloring layers from developing color.

3. A thermal color printing method according to claim 2, wherein the first thermosensitive coloring layer develops cyan color, the second thermosensitive coloring layer develops magenta color, and the third thermosensitive coloring layer develops yellow color.

4. A thermal color printing method according to claim 2, wherein a heat energy for recording the pixel at said final desired pixel density is selected from a heat energy area corresponding to a density area inclusive of a first density which is slightly higher than Dmax/N and lower than a second density from which an underlying layer of each of the first and second thermosensitive coloring layers stats coloring, where Dmax represents a maximum coloring density of one of the second and third thermosensitive coloring layers obtained by continuously energizing the predetermined width, and N represents the number of thermal recording times.

5. A color thermal printing method for recording a full-color image on a thermosensitive color recording material having at least first, second, and third thermosensitive coloring layers formed on a supporting material which are arranged in a predetermined order with the second thermosensitive coloring layer disposed on the first thermosensitive coloring layer and the third thermosensitive coloring layer disposed on the second thermosensitive coloring layer, by using a thermal head, the first thermosensitive coloring layer containing as the main components an electron-donor type dye precursor and an electron-acceptor type compound, the second thermosensitive coloring layer containing a first diazonium salt compound having a maximum absorption wavelength of 360±20 nm and a first coupler which develops color when the first coupler is thermally reacted with the first diazonium salt compound, the third thermosensitive coloring layer containing a second diazonium salt compound having a maximum absorption wavelength of 420±20 nm and a second coupler which develops color when the second coupler is thermally reacted with the second diazonium salt compound, the first, second and third thermosensitive coloring layers having the coloring characteristics that when the third thermosensitive coloring layer is selectively colored by continuously driving the thermal head with a first pulse having a first predetermined voltage and a first predetermined width, the second thermosensitive coloring layer is inevitably colored by a small amount, and after the third thermosensitive coloring layer is optically fixed and when the second thermosensitive coloring layer is selectively colored by continuously driving the thermal head with a second pulse having a second predetermined voltage and a second predetermined width, the first thermosensitive coloring layer is inevitably colored by a small amount, the thermal head having a plurality of heating elements, each of the heating elements being driven by a pulse train including a bias pulse for raising a temperature of each of the heating elements near to a coloring temperature and a plurality of image pulses which change in a power-on time depending upon the pixel density of an original image, and each of the heating elements heating the thermosensitive color recording material from a surface of the third thermosensitive coloring layer to selectively and thermally record one pixel on one of the first, second, and third thermosensitive coloring layers, the thermal color printing method comprising the steps of:

thermally recording either of the second and third thermosensitive coloring layers under the condition that the pulse train is divided into a plurality of subsidiary pulse trains, each of said subsidiary pulse trains recording the pixel at a density lower than a desired pixel density, and an entirety of said plurality of subsidiary pulse trains recording said pixel at a desired final pixel density; and forming an image of one color by using a plurality of sequential frame images, and thermally recording each of said plurality of sequential frame images by using said plurality of subsidiary pulse trains.

6. A thermal color printing method according to claim 5, wherein the first thermosensitive coloring layer develops cyan color, the second thermosensitive coloring layer develops magenta color, and the third thermosensitive coloring layer develops yellow color.

7. A thermal color printing method according to claim 6, wherein a heat energy for recording the pixel at said final desired pixel density is selected from a heat energy area corresponding to a density area inclusive of a first density which is slightly higher than Dmas/N and lower than a second density from which an underlying layer of each of the first or second thermosensitive coloring layers starts coloring, where Dmax represents a maximum coloring density of one of the second and third thermosensitive coloring layers obtained by continuously energizing the thermal head with a third pulse having a third predetermined voltage and a third predetermined width, and N represents the number of thermal recording times.

8. A color thermal printing device for forming a full-color image, comprising:

a thermosensitive color recording material for forming the full-color image thereon having at least first, second and third thermosensitive coloring layers of different developing colors, said second thermosensitive coloring layer being disposed on said first thermosensitive coloring layer and said third thermosensitive coloring layer being disposed on said second thermosensitive coloring layer;

recording and fixing means for thermally recording and optically fixing downward from said third thermosensitive coloring layer so that when said third thermosensitive coloring layer is colored by applying heat energy continuously or intermittently up to a predetermined density, said second thermosensitive coloring layer is inevitably colored by a small amount due to the characteristics of said thermosensitive color recording material and after said third thermosensitive coloring layer is optically fixed and when said second thermosensitive coloring layer is colored by applying heat energy continuously or intermittently up to a second predetermined density inclusive of a maximum density, said first thermosensitive coloring layer is inevitably colored by a small amount;

dividing means for dividing a thermal recording of one of said, second and third thermosensitive coloring layers into a plurality of coloring processes in order to color said one thermosensitive coloring layer selectively up to said second predetermined density inclusive of said maximum density;

suppressing means for suppressing an underlying layer which underlies said one thermosensitive coloring layer from developing color while coloring said one thermosensitive coloring layer during one of said coloring processes;

powering off means for providing a sufficient power off period to suppress said underlying layer from developing color when a subsequent coloring process follows; and color developing means for performing said respective coloring processes for color development up to said second predetermined density.

9. A color thermal printing device for forming a full-color image comprising:

a thermosensitive color recording material for forming the full-color image thereon having at least first, second and third thermosensitive coloring layers of different developing colors formed on a supporting material wherein, said first thermosensitive coloring layer being disposed on said supporting material and containing an electron-donor type dye precursor and an electron-acceptor type compound as the main components, said second thermosensitive coloring layer being disposed on said first thermosensitive coloring layer and containing a first diazonium salt compound having a maximum absorption wavelength of 360±20 nm and a first coupler which develops color when said first coupler is thermally reacted with said first diazonium salt compound, said third thermosensitive coloring layer being disposed on said second thermosensitive coloring layer and containing a second diazonium salt compound having a maximum absorption wavelength of 420±20 nm and a second coupler which develops color when said second coupler is thermally reacted with said second diazonium salt compound;

a thermal head including a plurality of heating elements for selectively coloring said third thermosensitive coloring layer by continuously driving said thermal head with a first pulse having a first predetermined voltage and a first predetermined width so that said second thermosensitive coloring layer is inevitably colored by a small amount and after said third thermosensitive coloring layer is optically fixed and when said second thermosensitive coloring layer is selectively colored by continuously driving said thermal head with a second pulse having a second predetermined voltage and a second predetermined width, said first thermosensitive coloring layer is inevitably colored by a small amount due to the coloring characteristics of said first, second and third thermosensitive coloring layers and after said second thermosensitive coloring layer is optically fixed, said first thermosensitive coloring layer is selectively colored by continuously driving said thermal head with a third pulse having a third predetermined voltage and a third predetermined width;

driving means for driving each of said heating elements by a pulse train including a bias pulse for raising the temperature of each of said heating elements near the color temperature and a plurality of image pulses which change in a power-on time depending upon the pixel density of an original image so that each of said heating elements heats said thermosensitive color recording material from the surface of said third thermosensitive coloring layer to selectively and thermally record one pixel on one of said first, second and third thermosensitive coloring layers;

dividing means for dividing said pulse train into a plurality of subsidiary pulse trains to thermally record either of said second and third thermosensitive coloring layers so that each said subsidiary pulse train records said pixel at a density lower than a desired pixel density and the entirety of said plurality of subsidiary pulse trains records said pixel at a desired final pixel density;

cooling period means for providing a cooling period between two adjacent of said subsidiary pulse trains, said cooling period being sufficiently longer than a power off time of each period of said image pulses; and supplying and suppressing means for consecutively supplying said plurality of subsidiary pulse trains to each thermal head to record said pixel on each of said first, second and third thermosensitive coloring layers while suppressing an underlying layer of each of said second and third thermosensitive coloring layers from developing color.

10. A color thermal printing device according to claim 9, wherein said first thermosensitive coloring layer develops cyan color, said second thermosensitive coloring layer develops magenta color and said third thermosensitive coloring layer develops yellow color.

11. A color thermal printing device according to claim 9, further comprising heat energy recording means for selecting a heat energy to second said pixel at said final desired pixel density from a heat energy area corresponding to a density area inclusive of a first density which is slightly higher than Dmax/N and lower than a second density from which an underlying layer of each of said first and second thermosensitive coloring layers starts coloring, where Dmax represents a maximum coloring density of one of said second and third thermosensitive coloring layers obtained by continuously energizing said thermal head with a third pulse having a third predetermined voltage and a third predetermined width and N represents the number of thermal recording times.

12. A color thermal printing device for forming a full-color image comprising:

a thermosensitive color recording material for forming the full-color image thereon having at least first, second and third thermosensitive coloring layers of different developing colors formed on a supporting material wherein, said first thermosensitive coloring layer being disposed on said supporting material and containing an electron-donor type dye precursor and an electron-acceptor type compound as the main components, said second thermosensitive coloring layer being disposed on said first thermosensitive coloring layer and containing a first diazonium salt compound having a maximum absorption wavelength of 360±20 nm and a first coupler which develops color when said first coupler is thermally reacted with said first diazonium salt compound, said third thermosensitive coloring layer being disposed on said second thermosensitive coloring layer and containing a second diazonium salt compound having a maximum absorption wavelength of 420±20 nm and a second coupler which develops color when said second coupler is thermally reacted with said second diazonium salt compound;

a thermal head and an optical fixing device, said thermal head including a plurality of heating elements for selectively coloring said third thermosensitive coloring layer by continuously driving said thermal head with a first pulse having a first predetermined voltage and a first predetermined width so that said second thermosensitive coloring layer is inevitably colored by a small amount and after said third thermosensitive coloring layer is optically fixed by said optical fixing device and when said second thermosensitive coloring layer is selectively colored by continuously driving said thermal head with a second pulse having a second predetermined voltage and a second predetermined width, said first thermosensitive coloring layer is inevitably colored by a small amount due to the coloring characteristics of said first, second and third thermosensitive coloring layers;

driving means for driving each of said heating elements by a pulse train including a bias pulse for raising a temperature of each of said heating elements near a color temperature and a plurality of image pulses which change in a power-on time depending upon a pixel density of an original image so that each of said heating elements heats said thermosensitive color recording material from a surface of said third thermosensitive coloring layer to selectively and thermally record one pixel on one of said first, second and third thermosensitive coloring layers;

dividing means for dividing said pulse train into a plurality of subsidiary pulse trains to thermally record either of said second and third thermosensitive coloring layers so that each of said subsidiary pulse trains records said pixel at a density lower than a desired pixel density and the entirety of said plurality of subsidiary pulse trains records said pixel at a desired final pixel density;

image forming means for forming an image of one color by using a plurality of sequential frame images so that the thermal recording of each of said plurality of sequential frame images is performed in response to said plurality of subsidiary pulse trains.

13. A color thermal printing device according to claim 12, wherein said first thermosensitive coloring layer develops cyan color, said second thermosensitive coloring layer develops magenta color and said third thermosensitive coloring layer develops yellow color.

14. A color thermal printing device according to claim 12, further comprising heat energy recording means for selecting a heat energy to second said pixel at said final desired pixel density from a heat energy area corresponding to a density area inclusive of a first density which is slightly higher than Dmax/N and lower than a second density from which an underlying layer of each of said first and second thermosensitive coloring layers starts coloring, where Dmax represents a maximum coloring density of one of said second and third thermosensitive coloring layers obtained by continuously energizing said thermal head with a third pulse having a third predetermined voltage and a third predetermined width and N represents the number of thermal recording times.

15. A color thermal printing method for forming a full color image on a thermosensitive color recording material including a plurality of thermosensitive coloring layers, the color thermal printing method comprising the steps of:

dividing a thermal recording process for one of said plurality of thermosensitive coloring layers into a plurality of coloring processes;

selectively coloring said one thermosensitive coloring layer up to a predetermined maximum density;

suppressing an underlying layer to said one thermosensitive coloring layer from developing color during one of said coloring processes;

providing a sufficient power off period for suppressing said underlying layer from developing color when a subsequent coloring process follows; and performing said coloring processes for color development up to said predetermined maximum density.

16. A color thermal printing method according to claim 15, wherein said plurality of thermosensitive coloring layers comprises a first thermosensitive coloring layer, a second thermosensitive coloring layer disposed on said first thermosensitive coloring layer and a third thermosensitive coloring layer disposed on said second thermosensitive coloring layer.

17. A color thermal printing method according to claim 16, wherein said first thermosensitive coloring layer develops cyan colors, said second thermosensitive coloring layer develops magenta colors and said third thermosensitive coloring layer develops yellow colors.

18. A color thermal printing device for forming a full color image on a thermosensitive color recording material including a plurality of thermosensitive coloring layers, comprising:

dividing means for dividing a thermal recording process for one of said plurality of thermosensitive coloring layers into a plurality of coloring processes;

coloring means for selectively coloring said one thermosensitive coloring layer up to a predetermined maximum density and performing said coloring processes for color development up to said predetermined maximum density; and suppressing means for suppressing an underlying layer to said one thermosensitive coloring layer from developing color during one of said coloring processes by providing a sufficient power off period to suppress said underlying layer from developing color when a subsequent coloring process follows.

19. A color thermal printing device according to claim 18, wherein said plurality of thermosensitive coloring layers comprises a first thermosensitive coloring layer, a second thermosensitive coloring layer disposed on said first thermosensitive coloring layer and a third thermosensitive coloring layer disposed on said second thermosensitive coloring layer.

20. A color thermal printing device according to claim 19, wherein said first thermosensitive coloring layer develops cyan colors, said second thermosensitive coloring layer develops magenta colors and said third thermosensitive coloring layer develops yellow colors.

* * * * *